United States Patent [19]

Bassetti et al.

[11] 4,272,908

[45] Jun. 16, 1981

[54] ELECTRIFIED DOLL HOUSE FIREPLACE

[76] Inventors: Henry Bassetti, c/o George Spector, 3615 Woolworth Bldg., 233 Broadway; George Spector, 3615 Woolworth Bldg., 233 Broadway, both of, New York, N.Y. 10007

[21] Appl. No.: 48,748

[22] Filed: Jun. 15, 1979

[51] Int. Cl.[3] ..... A63H 33/00

[52] U.S. Cl. ..... 46/12; 40/428

[58] Field of Search ..... 46/14, 228, 229, 226, 46/15, 227, 11, 1 R, 12; 272/8 F; 40/428

[56] References Cited

U.S. PATENT DOCUMENTS 566,564 8/1896 Dewey ..... 272/8 F 2,219,507 10/1940 Apgar et al. ..... 46/12

2,631,040 3/1953 Constantine ..... 40/428

FOREIGN PATENT DOCUMENTS 416358 9/1934 United Kingdom ..... 40/428

1088577 10/1967 United Kingdom ..... 40/428

*Primary Examiner*—Gene Mancene

*Assistant Examiner*—Mickey Yu

[57] ABSTRACT

A miniature fireplace for a doll house, the fireplace producing a flickering light, by including at least one miniature electric lamp hidden behind logs placed on a grate fitted into the fireplace, the lamp being in an electrical circuit with a flasher unit, a switch and a dry cell battery hidden behind the fireplace facade.

3 Claims, 7 Drawing Figures

FLICKER UNITS
BATTERY

ELECTRIFIED DOLL HOUSE FIREPLACE

This invention relates generally to miniature furniture such as is used for furnishing a doll house.

A principal object of the present invention is to provide a dollhouse fireplace which emits a glowing light, so as to imitate a fire burning in the fireplace, for an improved realism.

Another object is to provide a doll house fireplace wherein the glowing light is produced by a miniature electric lamp in circuit with a hidden dry cell battery, so that there is no open flame and resultant danger of causing an actual fire.

Still another object is to provide a dollhouse fireplace which in another design thereof creates a glowing light that flickers irregularly so as to be further more realistic in effect by resembling a glowing fire with occassional flames or sparks.

Figures 1, 2, 3, 4, 5, 6, 7:
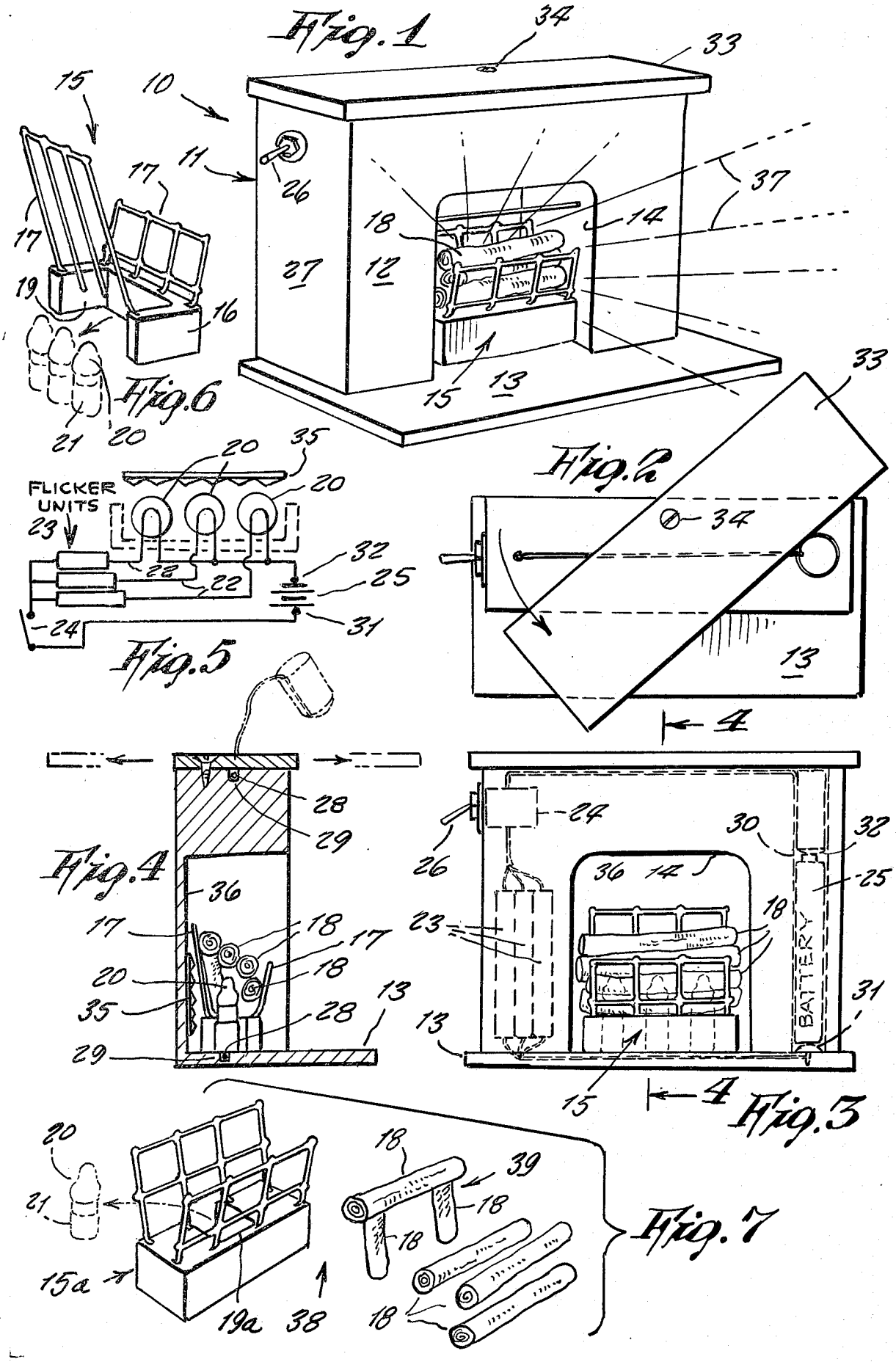
FIG. 1 is a perspective view of the invention.
FIG. 2 is a top view thereof with top cover pivoted open partly for battery replacement.
FIG. 3 is a front view thereof and showing the electric circuit including three lamps each connected to its own flicker component so that in use, the light from the fireplace flickers at different times from each lamp in order to more realistically imitate a burning wood fire.
FIG. 4 is a cross sectional view on line 4—4 of FIG. 3, and showing a diamond shaped reflector surface in the fireplace rear for additional sparkle.
FIG. 5 is an electric circuit of the device.
FIG. 6 is a grate of the fireplace shown in FIG. 3.
FIG. 7 is a view of grate details of another design of the invention which uses only one lamp, and no flicker unit in the circuit.

Referring now to the drawing in greater detail, and more particularly to FIGS. 1 through 6 thereof at this time, the reference numeral 10 represents an electrified dollhouse fireplace according to the present invention, wherein there is a fireplace block 11 made either of wood, cast material or the like and which includes a front facade 12 that may be made to imitate either brick, stone or the like. The block is permanently mounted upon a flat base 13 which extends forewardly so as to imitate a hearth or hearth stone. A recess 14 within a front side of the block is made to resemble a real fireplace opening in which wooden logs loaded on a grate are burned.

In the present invention, a grate 15 is slided into the recess 14, the grate comprising a base 16 having angularly upwardly extending front and rear meshes 17 made of a course screen wire so as to form a cradle therebetween into which wooden twigs 18 as placed to resemble logs. As shown in FIG. 6, the rear side of the base has a notch 19 so that three miniature electric lamps 20 fitted in electric sockets 21 mounted upon the base, can be enclosed by the base and by the twigs loaded into the cradle of the grate, as shown in FIG. 4.

The lamps are in parallel circuits 22 each of which includes a flasher unit 23 of different contact closing timing, and the circuits are connected to a single common switch 24 and dry cell battery 25, as shown in FIG. 5. The circuits and their components are hidden inside the block 11 which is hollowed out so as to contain them. A switch button 26 alone is visible protruding from a side wall 27 of the block so to be manually operated. The wiring 28 of the circuits is hidden inside grooves 29 cut in the block and in the base, as shown in FIG. 4.

The battery is dropped into a hole 30 through the block, so to rest upon a contact 31, while a contact 32 is then placed into the hole therealone.

The upper end of the hole 30 and the groove 29 upon a top of the block are hidden by a flat board 33 thereabove serving as a mantle for the fireplace. The board swivels about a screw 34 so to swing into opened position, allowing access for a battery change.

In operative use, it is now evident that a glowing light emits from behind the twig "logs" the light flickering as different ones of the lamps go off and on. A reflector 35 on a back wall 36 of the recess additionally throws light rays 37 forwardly.

In a modified design 38, shown in FIG. 7, the grate **15*a* is designed with a narrow notch 19*a*** so to enclose only a single lamp and socket. In this design the circuit does not have a flasher unit, as the single lamp glows continuously when the switch is turned on, so to give the effect of glowing coals only, within the fireplace.

The "logs" include a log unit 39 made of three twigs affixed together into a U-shaped in order to bridge across the lamp, and support the center twig securely over the lamp while the end twigs enclose the lamp at each side from view.

What is claimed:

1. A miniaturized electrical fireplace for a doll house comprising a block supported on a base with a mantle secured pivotally to the top of said block in combination with a grate and simulated logs, said block including a recess at the block bottom adapted to receive said grate supported on said base, said grate comprising a support with opposing grate mesh retainers for supporting said simulated logs, said support including a notched out portion to receive therein at least one lamp mounted on said base, said retainers having means for supporting said logs in a manner to obscure said lamp, said block further including hollowed out portions and an electrical circuit including battery means located therein for lighting said lamp.

2. A fireplace as in claim 1 wherein said logs include a U-shaped log with spaced vertical units for bridging over the lamp, said circuit including lamp flickering means.

3. A fireplace as in claim 2 wherein the mantle is pivotally secured over said hollowed out portions to enclose the same in a closed position and to provide access to said portions in an open position.

* * * * *